US005534988A

United States Patent [19]

Gerbasi

[11] Patent Number: 5,534,988

[45] Date of Patent: Jul. 9, 1996

[54] RETRACTION ACTIVATED WASTE BOTTLE MECHANISM FOR UNIFORM TONER DISTRIBUTION

[75] Inventor: Dennis G. Gerbasi, Webster, N.Y.

[73] Assignee: Xerox Corporation, Stamford, Conn.

[21] Appl. No.: 479,434

[22] Filed: Jun. 7, 1995

[51] Int. Cl.[6] ..... G03G 21/00

[52] U.S. Cl. ..... 355/298

[58] Field of Search ..... 355/296, 298, 355/260

[56] References Cited

U.S. PATENT DOCUMENTS

| | | | |
|---|---|---|---|
| 4,131,359 | 12/1978 | Honda | 355/298 |
| 4,593,997 | 6/1986 | Fox et al. | 355/298 |
| 4,650,312 | 3/1987 | Vineski | 355/298 |
| 4,739,907 | 4/1988 | Gallant | 222/240 |
| 4,943,830 | 7/1990 | Sulenski | 355/245 |
| 5,257,077 | 10/1993 | Peters, Jr. et al. | 355/260 |
| 5,442,422 | 8/1995 | Owens, Jr. et al. | 355/298 X |

FOREIGN PATENT DOCUMENTS

| | | | |
|---|---|---|---|
| 61-204673 | 9/1986 | Japan | 355/298 |

*Primary Examiner*—Joan H. Pendergrass
*Assistant Examiner*—Sophia S. Chen
*Attorney, Agent, or Firm*—T. L. Fair

[57] ABSTRACT

An apparatus and method for preventing nonuniform accumulation of toner collected in a waste container of particles cleaned from a surface. The apparatus and method for disturbing the particles to provide uniform accumulation of toner in the waste container are driven by the same cam shaft, cam or solenoid used by the cleaner brushes for engaging and retracting the cleaner brushes from the surface. The waste container or cleaner subsystem is either thumped, moved back and forth, internally agitated or in some way disturbed to enable uniform toner distribution inside the waste container and better utilization of the storage capacity of the waste container.

20 Claims, 5 Drawing Sheets

RETRACTION ACTIVATED WASTE BOTTLE MECHANISM FOR UNIFORM TONER DISTRIBUTION

BACKGROUND OF THE INVENTION

This invention relates generally to a cleaning apparatus, and more particularly concerns a retraction activated mechanism for uniform toner distribution.

A variety of methods have been used in cleaning systems, to collect waste toner in cleaner waste bottles. Such methods include cleaning systems utilizing: augers to pack the toner into the waste bottle; augers to drop toner from the top of the bottle; a vacuum source with expensive toner separators and filter bags; and, toner dropping directly into the waste bottle. A disadvantage of these toner collection systems has been the distribution of toner in the waste bottle. Inappropriate toner distribution within the waste bottle prevents maximization of toner capacity in the waste bottle prior to removal from the cleaning system. For example, in direct drop cleaning systems, if many copies are run which have a large waste toner input to a particular location of the document, the corresponding location in the waste bottle will fill first. Another example occurs in cleaning systems with augers. Without a packing auger, the waste toner bottle fills unevenly due to the inability of the system to distribute the waste toner in the waste toner bottle.

The following disclosures may be relevant to various aspects of the present invention and may be briefly summarized as follows:

U.S. Pat. No. 4,593,997 to Fox et al. discloses an apparatus for removing toner from a charge-retentive surface and collecting the toner in a receptacle for subsequent disposal thereof. This apparatus is characterized by the provision of a segmented auger structure which is disposed internally of the receptacle such that toner is moved into the receptacle through a vertical one end thereof and positively transported by auger action across the entire length of the receptacle. The segmented auger functions to move toner by means of the two auger sections and causes toner moved by the auger sections to push toner between the two auger sections and between one of the auger sections and the end of the receptacle.

U.S. Pat. No. 4,650,312 to Vineski discloses an apparatus for removing toner from a charge-retentive surface and collecting the toner in a receptacle for subsequent disposal thereof. This apparatus is characterized by the provision of structure for minimizing bridging or packing of toner in the flights of an auger forming a part of the removal and collection system as disclosed in the specification. The toner anti-bridging structure provides for imparting vibratory motion directly to the anger. To this end the anti-bridging includes a pendulum which is caused to periodically bang into the auger to create vibrations in the auger structure.

U.S. Pat. No. 4,739,907 to Gallant discloses a cylindrical developer storage and dispensing opening at one end that has an integral developer transport mixing and anti-bridging member rotatably supported within the container which has a first coiled spring element. This first coiled spring element has a cross section substantially the same as the cross section of the container and freely rotatable therein.

U.S. Pat. No. 4,943,830 to Sulenski discloses a developer dispensing apparatus that includes a coiled spring auger which is rotated through a developer bed in a direction to dispense developer through a dispensing opening. The spring auger has an unsupported free end which is nonfixedly placed over a hold down mechanism attached to one end of the developer housing and which projects inwardly into the toner bed. As the spring auger rotates, a tendency of the free end to vertically rise from the developer is inhibited by making contact with the hold down mechanism. By proper configuration of the contacting surface of the hold down mechanism, a thumping or anti-bridging action is imparted to the toner by periodically causing the coiled end to wind and unwind storing and releasing energy along the developer bed length.

U.S. Pat. No. 5,257,077 to Peters, Jr. et al. discloses a toner cartridge for dispensing toner on demand to the development station of a xerographic copier machine. The cartridge is modified so as to improve the dispensing of toner through dispensing ports located at one end of the cartridge by the provision of a relatively stiff, coiled spring element which is fixed in position adjacent the interior walls of the cartridge. As the cartridge rotates, the spring moves through the toner acting as an auger-type transport mechanism to move the toner towards the dispensing ports. The spring also serves to agitate the toner so as to make its consistency more fluid thereby aiding the augering transport motion.

SUMMARY OF INVENTION

Briefly stated, and in accordance with one aspect of the present invention, there is provided an apparatus for cleaning particles from the surface. The apparatus comprises means for removing the particles from the surface and, a waste container positioned to receive the particles removed from the surface by the removing means, the particles having nonuniform accumulation in the waste container. The apparatus also comprises a device for engaging and retracting the removing means from the surface and, means for disturbing the nonuniform accumulation of the particles in the waste container, the disturbing means being made operable by the device.

Pursuant to another aspect of the present invention, there is provided a method of preventing particles, removed from a surface and collected in a waste container, from nonuniform accumulation in the waste container, comprising: removing the particles from the surface using a cleaning device; collecting particles from the surface that accumulate nonuniformly in the waste container; and disturbing the nonuniform accumulation of the particles in the waste container, using a disturbing device, during engaging and retracting of the cleaning device using a cam to simultaneously operate the cleaning device and disturbing device.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
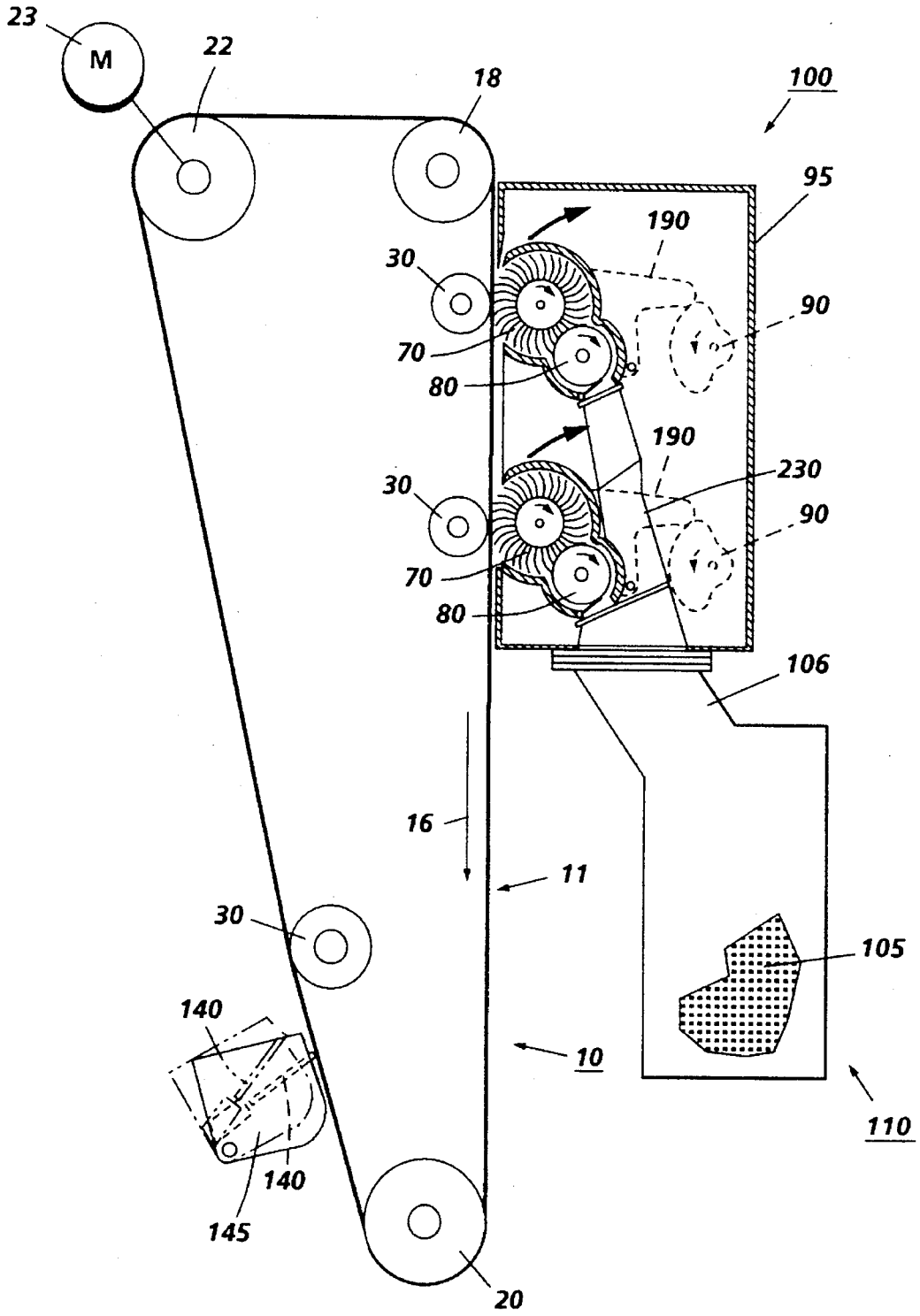
FIG. 1 is a schematic illustration of a printing apparatus incorporating an embodiment of the inventive features of the present invention.

Referring now to FIG. 1, which is an elevational schematic illustration of an electrostatographic machine incorporating the inventive features of the present invention. The electrostatographic machine, from which the present invention finds advantageous use, utilizes a charge retentive member in the form of the photoconductive belt 10 consisting of a photoconductive surface 11 and an electrically conductive, light transmissive substrate mounted for movement past several stations (not shown) which include a charging station, exposure station, developer station, transfer station, fusing station and cleaning station. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 22 to advance belt 10 in the direction of arrow 16. Roller 22 is coupled to motor 23 by suitable means such as a belt drive.

In multi-pass color image on image mid-volume product, the cleaner of choice is a miniaturized dual electrostatic brush (MDESB) cleaner. The schematic illustration shows cleaner subsystem 100 in a 3 o'clock position. The cleaner comprises two brushes 70 with corresponding adjacent detoning rolls 80 inside a cleaner housing composed of two (inboard, outboard) end plates 95. Back up rollers 30 to support the photoreceptor belt 10 are located on the underside of the belt 10 opposite the cleaner brushes 70 and the spots blade 140. The cleaner brushes 70 and the spots blade 140 retract from the photoreceptor 10 during the multi-pass image on image process of building color images on the photoreceptor 10 prior to transfer to a paper or like media. The retraction and the engagement of the cleaner brushes 70 are made operable by the rotational movement of cams 90. The brush housing end plates 190 ride along the cam surfaces to retract and engage the cleaner brushes 70 with the photoreceptor 10.

With continuing reference to FIG. 1, the toner waste container or bottle 110 is positioned below the cleaner subsystem 100 and the toner particles 105 fall directly into the waste container 110. An angled chute 106 is shown as a part of the waste container 110 that can be used to prevent interference with charging stations or other parts of the printing machine. The waste bottle 110 is attached to the cleaning apparatus by a sliding track or like coupling method. A spots blade 140 is shown in the wiping mode for cleaning spots from the photoreceptor surface. The spots blade 140 retracts and engages in the same manner as the brush cleaners 70 using a solenoid rather than a cam. The spots blade 140 collects particles removed from the photoreceptor in a toner collector 145.

Additionally, the spots blade 140, shown in FIG. 1, could also have a thumper added to distribute the toner. For example, in some machines the inboard and outboard ends of the waste collection system collect toner while the middle of the collection tray does not. As a result, the collection tray has to be emptied when the middle of the tray is not full. Placing a thumper or like mechanism at the spots blade 140 location resolves this inefficiency.

Figure 2A:
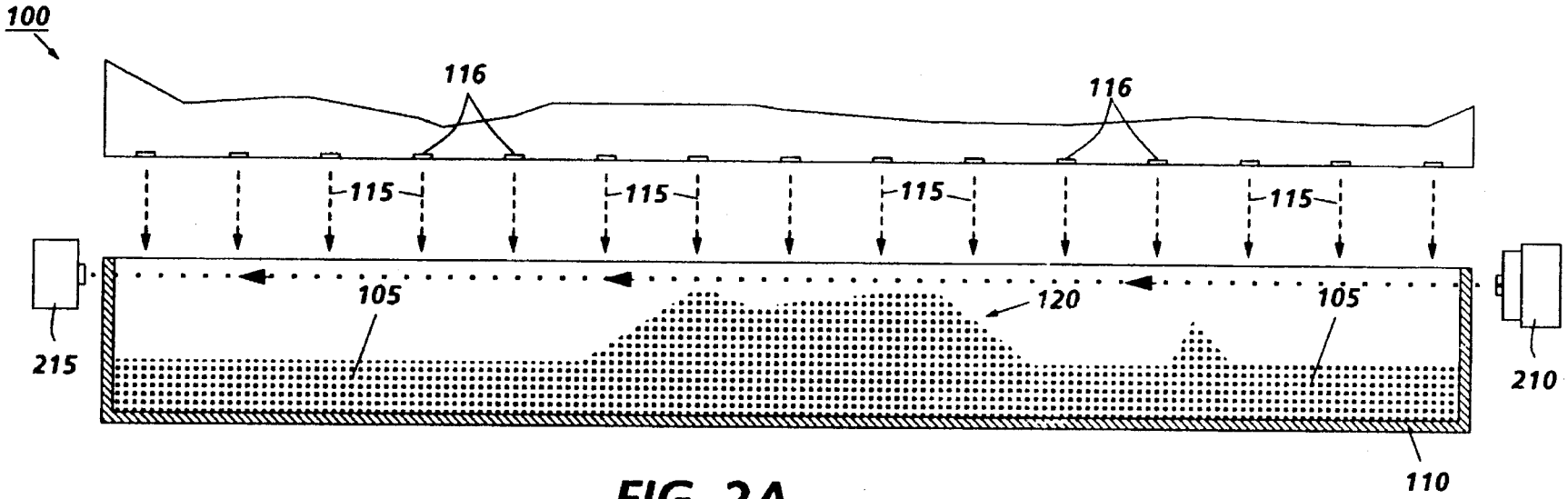
FIG. 2A is an elevational schematic illustration of direct drop toner disposal particle distribution in the waste container.
Figure 2B:
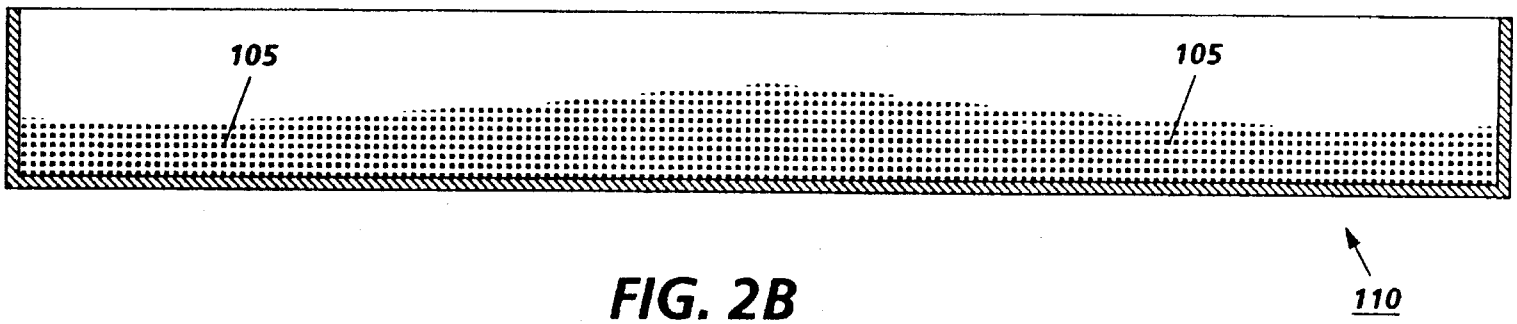
FIG. 2B is an elevational schematic of the waste container particle distribution using the present invention.

Prior to the present invention, the filling of the waste bottle was not uniform due to the lack of uniform distribution of the toner therein. This lack of uniform distribution is shown in FIG. 2A, which shows an elevational schematic illustration of direct drop toner disposal particle distribution into the waste toner bottle 110. The toner particles 105 are dropped from the cleaner 100, in the direction shown by the arrows 115, through apertures 116 in the cleaner 100 located directly above the waste container 110. This direct drop toner disposal technique creates mountains or peaks 120 in the toner 105 within the waste container 110 creating nonuniform distribution. These mountains or peaks 120 in the toner, trip a sensing device (e.g. the light beam between the emitter 210 and the detector 215) indicating erroneously that the storage capacity of the waste container 110 is full. This nonuniform distribution (or accumulation) gives the appearance of a full waste bottle 110. Thus, customer intervention or replacement of the waste container 110 occurs more frequently than required because the storage capacity of the toner bottle has not been fully utilized. FIG. 2B shows an elevational schematic of the waste toner bottle 110 particle distribution after using an embodiment of the present invention, to uniformly distribute the toner particles 105 throughout the waste toner bottle 110.

Figure 3:
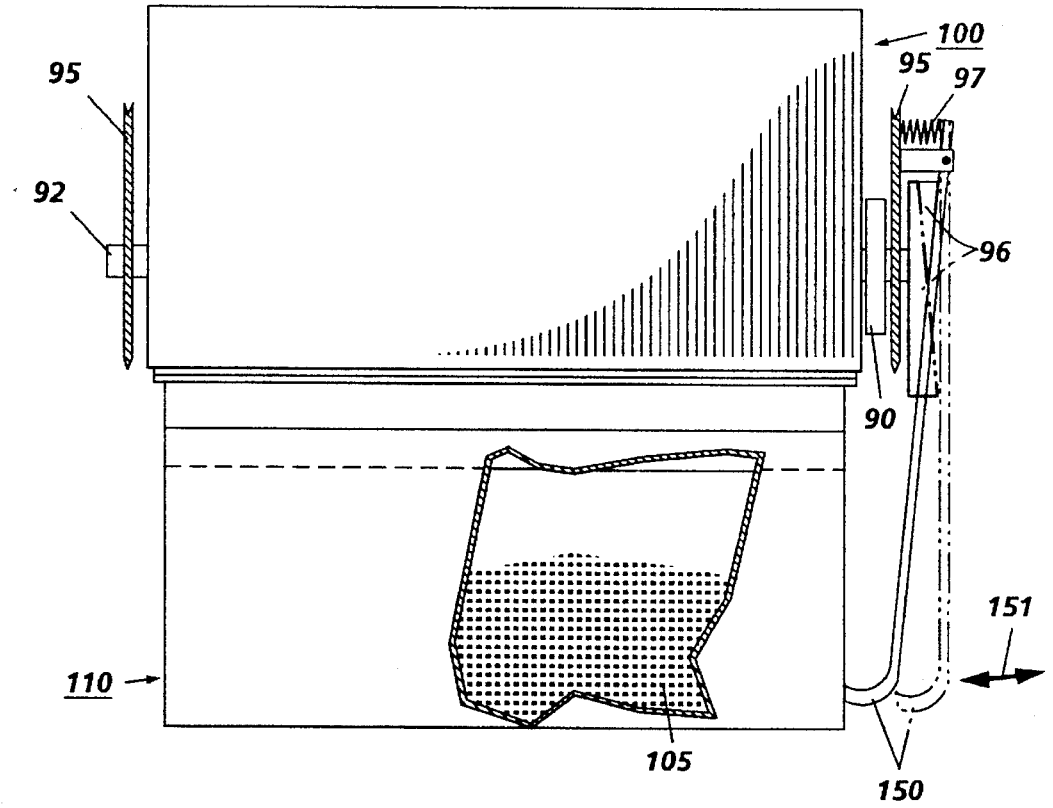
FIG. 3 is a schematic of an embodiment of the present invention incorporating a thumper made operable using the cleaner subsystem cam shaft.

Reference is now made to FIGS. 3–6 which show embodiments of the present invention to prevent nonuniform distribution of toner in the waste container. Referring now to FIG. 3, which shows a schematic of the preferred embodiment of the present invention, incorporating a thumper made operable by the cam shaft 92 from the cleaner subsystem 100. This cam shaft 92 drives both the cleaner subsystem cam 90 and a second cam 96. The second cam 96 has an angled raised face. As the cam shaft 92 rotates, the widest point of the angled face cam 96 pushes against the thumper 150 to move the thumper 150 out of contact with the waste container 110. The further rotation of the angled faced cam 96 moves the widest portion or tip of the cam 96 out of contact with the thumper 150. The thumper 150 which has been riding along the surface of the angle faced cam 96, then falls out of contact with the angle faced cam 96, as the widest portion of the cam 96 moves out of contact with the thumper 150, causing the thumping or hitting action of the thumper 150 against the waste container 110 (or the support bracket that couples the waste bottle to the cleaner subsystem 100). The movement of the thumper 150, driven by the cam shaft 92, is shown by the arrow 151. The phantom line configuration of the thumper 150 and cam 96 show this movement. A compression spring 97 assists the thumping (i.e. hitting) action of the thumper 150 against the waste container 110. The "thumping" action causes toner that has accumulated or bridged in portions of the cleaner housings, adhered to the housing or waste bottle walls, and/or accumulated in the waste bottle entrance, to fall into the waste container 110.

With continued reference to FIG. 3, this "thumping" action against the waste container 110 evenly (e.g. uniformly) distributes the toner 105 in the waste container 110. Furthermore, this "thumping" action increases the toner storage capacity of the waste container 110 (i.e the "thumping" causes the toner to pack together tighter in the waste container), reducing the possibility of toner bridging, toner accumulation and toner emissions during waste bottle replacement. When the customer replaces the waste container 110, the toner emissions are reduced because there is less toner inside the cleaner subsystem when the waste bottle is replaced. (It is noted that the "thumping" action applied to the waste container can be applied to the cleaner to remove toner accumulation within the cleaner subsystem whether or not a waste container is present.) The cam shaft 92 retraction mechanism for the cleaner brushes also drives (i.e. operates) the thumper 150 (and other embodiments of the present invention). Likewise, the driving mechanism (i.e. cam shaft 92) for the other embodiments (see FIGS. 4–6) of the present invention, is already present in the cleaner. Thus, the only additional unit manufacturing cost for the present invention to the present cleaner apparatus would be the cost of the thumper 150 and the cost of the holder for the thumper 150.

With continued reference to FIG. 3, the thumper 150 is only activated upon cleaner brush engagement and retraction. Cleaner brush retraction and engagement is accomplished by rotating the cam 90. The cam shaft rotates a ½ revolution for cleaner brush engagement to occur, and another ½ revolution for cleaner retraction to occur. The present invention, utilizes the rotational motion of the cam shaft 92 to drive the thumper 150 as described above. The cam shaft 92 rotates during cycle-up, cycle-out, and during color copying (i.e. image on image). This causes the "thumping" action of the thumper 150 to be intermittent (i.e. only during retraction or engagement of the cleaner brushes). If the thumper 150 was driven by a separate drive other than that used for retraction of the cleaner brushes, the thumper 150 would operate continuously creating constant noise from the "thumping" action and annoying the customer.

Figure 4:
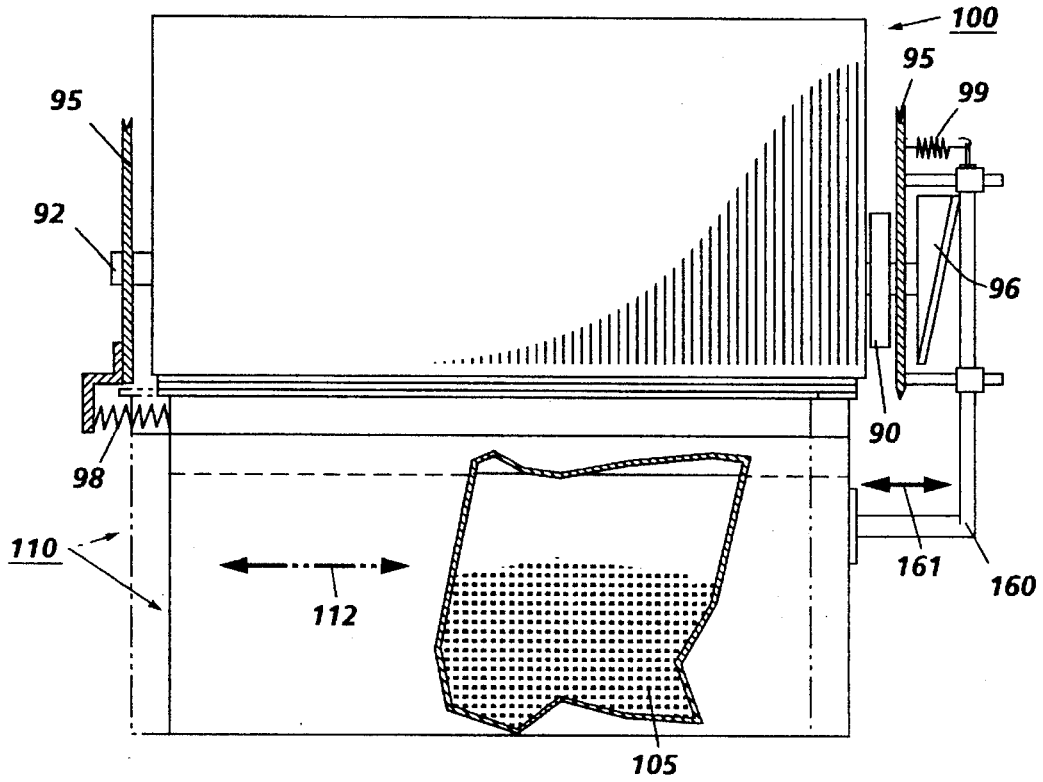
FIG. 4 is a schematic of another embodiment of the present invention incorporating translation of the waste container back and forth.
Figure 5:
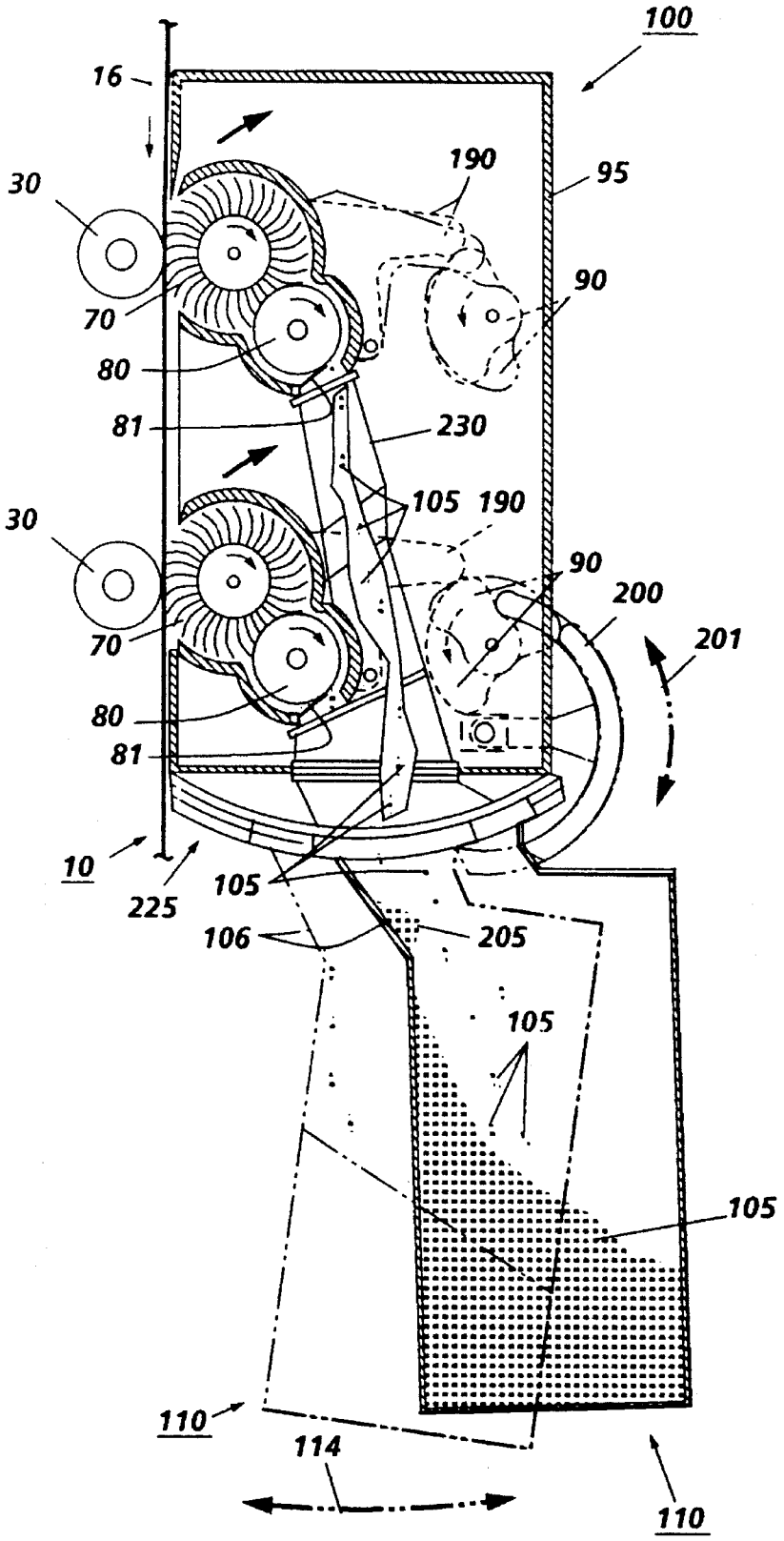
FIG. 5 is a schematic of another embodiment of the present invention incorporating rotation of the waste container back and forth.
Figure 6:
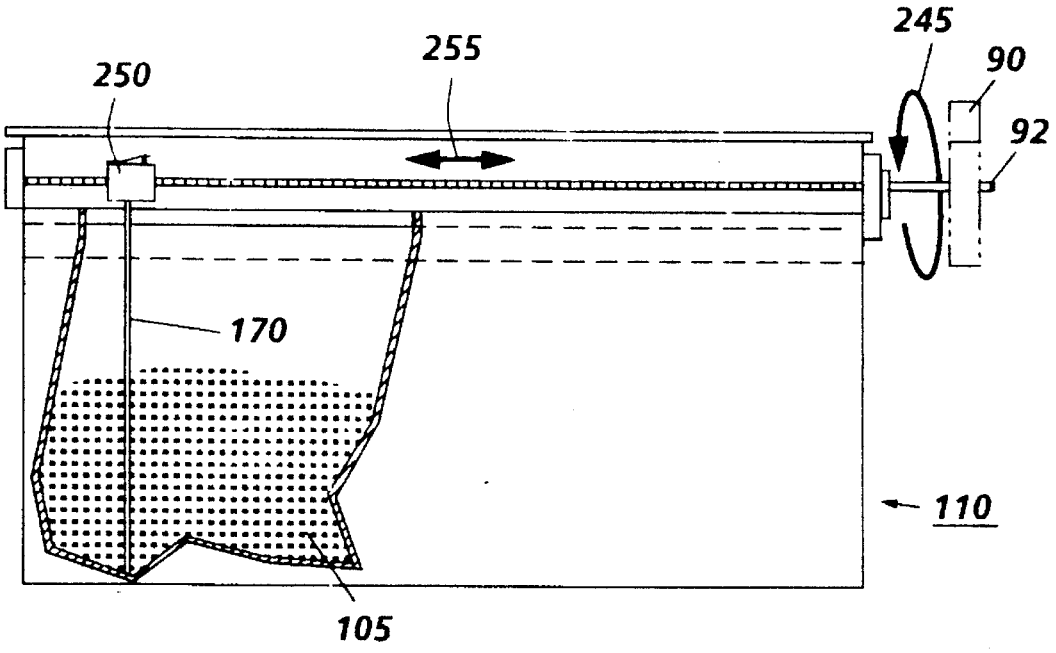
FIG. 6 is a schematic of another embodiment of the present invention incorporating movement of a wire through the toner inside the waste container.

Alternative embodiments to the preferred embodiment shown in FIG. 3, are shown in FIGS. 4–6. FIG. 4 shows the translation of the waste bottle back and forth using a plunger 160. This embodiment operates similarly to that of the thumper (see FIG. 3) in that the cam shaft 92, rotates the angled faced cam 96, in order to move the plunger 160 in a translating direction shown by the arrow 161. The compression spring 98 and the tension spring 99 assist the plunger 160 in the translating motion back and forth of the waste container 110 shown in phantom lines. This back and forth motion, shown by arrow 112 causes a "sifting" action to occur. This "sifting" action is shown in phantom lines in FIG. 4. The "sifting" action occurs during retraction and engagement of the cleaner brushes because the cam shaft 92, for the cleaner brushes, also drives the plunger 160 via the angled faced cam 96. This "sifting" action, of the present invention, causes the toner to distribute evenly and also for the toner particles 105 to more densely pack the waste container 110. The architecture of the plunger 160 apparatus provides the "sifting" action rather than the jolting (e.g. thumping) action of the thumper in FIG. 3.

Reference is now made to FIG. 5, which shows a schematic of another embodiment of the present invention incorporating rotation of the waste container 110 back and forth. This back and forth or rotational motion of the waste container 110, shown by arrow 114, is achieved by the retraction activated arm 200 that rides directly on the surface of cam 90. As the cam 90 is rotated, the retraction activated arm 200 moves in a manner shown by arrow 201. The motion of the retraction arm moves the waste container 110 back and forth in a track 225 where the waste container 110 is coupled to the cleaner subsystem 100. (It is noted that this back and forth motion could also be achieved by making the coupling area between the cleaner subsystem 100 and waste container 110 flexible.)

With continued reference to FIG. 5, toner particles 105 removed from the detoning rolls 80 by scraper blades 81 are guided toward the waste container 110 through a toner chute 230. The toner particles can accumulate in the toner chute 230 and in the waste container 110. This back and forth motion moves particles 105 that have accumulated in the toner chute 230 and on the inner ledge (as shown by 205) of the chute 106 such that they fall into the waste container 110 and shift as shown by the phantom configuration of 110.

Reference is now made to FIG. 6, which shows a schematic of another embodiment of the present invention incorporating movement of a wire through the toner inside the waste container. In this embodiment of the present invention, a wire 170 (e.g. bent in an "S" configuration) or spring is positioned inside a stationary waste container 110. The wire 170 is attached to an end cap 250 mounted on the cam shaft 92 covered by a threaded surface. The cam shaft 92 rotates in the direction shown by arrow 245. The threaded surface, driven by the cam shaft 92, allows for incremental movement of the end cap 250 in one direction shown by arrow 255 as the cleaner brushes retract and engage. The wire 170, attached to the end cap 250, incrementally moves through the toner particles 105, collecting in the waste container 110. Once the end point in the incremental movement of the end cap 250 in the one direction is reached, the loose fitting end cap 250, due to a spring force, moves continuously in the opposite direction, also shown by arrow 255, from the incremental movement direction. This return movement of the end cap 250 and the wire 170 is not incremental but a continuous motion of the wire 170 through the toner particles 105 back to the beginning point of incremental movement through the toner particles 105. The incremental movement in one direction and the continuous return movement of the wire 170 in the opposite direction uniformly distributes the toner throughout the waste container 110.

With continued reference to FIGS. 3–6, the present invention provides intermittent contact to the waste container 110. This contact is intermittent because the toner distribution and anti-bridging action of the embodiments of the present invention is made operable by the cleaner subsystem cam 90 that engages and retracts the cleaner brushes. Thus, the anti-bridging and toner distribution embodiments only operate upon retraction or engagement of the cleaner brushes.

Other methods of waste bottle toner distribution include using a paddle wheel inside the toner bottle or other hybrids of the above mentioned embodiments of the present invention.

In recapitulation, the preferred embodiment involves a thumping action against the waste bottle to uniformly distribute the toner in the waste bottle for increased waste bottle storage capacity. Other embodiments of the present invention include translating the waste toner bottle back and forth using a plunge, rotating the waste toner bottle back and forth and movement of a wire or spring inside a waste toner bottle for uniform distribution of toner therein. The main advantage of any of these embodiments over the prior art, is that the mechanical driver for the toner distribution embodiment is already present in the cleaner and that the driver is intermittent. Thus, noise pollution is reduced. Additionally, the present invention embodiments are simple add-ons that uniformly distribute the toner, increase waste bottle capacity, and increase the reliability of the cleaner (i.e. by reducing the toner inside of the cleaner) for a low UMC (unit manufacturing cost).

It is, therefore, apparent that there has been provided in accordance with the present invention, a toner distribution and anti-bridging apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

means for removing the particles form the surface, the surface having motion;

a waste container positioned to receive the particles removed from the surface by said removing means, the particles having nonuniform accumulation in said waste container;

a device for engaging said retracting said removing means from the surface; and means for disturbing the nonuniform accumulation of the particles in said waste container creating uniform distribution of the particles therein, said disturbing means being coupled to said device and being made operable by said device.

2. An apparatus as recited in claim 1, wherein said device comprises a solenoid.

3. An apparatus as recited in claim 1, wherein said device being rotatable moves said disturbing means into and out of contact intermittently with said waste container.

4. An apparatus as recited in claim 3, wherein the rotatable movement of said device simultaneously operates said disturbing means and said removing means.

5. An apparatus as recited in claim 4, wherein said waste container defining a packing capacity therein, the packing capacity being increased by the uniform accumulation of the particles in said waste container.

6. An apparatus as recited in claim 5, wherein said waste container is positioned downstream, in a direction of motion of the surface, from said removing means to receive particles cleaned from the surface by said removing means.

7. An apparatus as recited in claim 6, wherein the particles removed from the surface enter said waste container using a particle drop subsystem.

8. An apparatus for cleaning particles from a surface, comprising:

means for removing the particles from the surface, the surface having motion;

a waste container positioned to receive the particles removed from the surface by said removing means, the particles having nonuniform accumulation in said waste container, said waste container being positioned downstream, in a direction of motion of the surface, from said removing means to receive particles cleaned from the surface by said removing means;

means for distributing the nonuniform accumulation of the particles in said waste container creating uniform accumulation therein, said waste container defining a packing capacity therein, the packing capacity being increased by the uniform accumulation of the particles in said waste container;

a device for engaging and retracting said removing means from the surface, said device being rotatable moves said disturbing means into and out of contact intermittently with said waste container; and a particle drop subsystem for guiding the particles removed from the surface into said waste container, said particle drop subsystem comprising:

a cleaner subsystem, having an aperture through which the particles removed from the surface escape; and a chute defining two end openings, having a first end opening and a second end opening opposite one another, the first end being adjacent the aperture of said cleaner subsystem, said chute located downstream, in the direction of motion of the surface, from said cleaner subsystem, receives the particles escaping through the aperture into the first end opening, the particles flow through said chute to the second end opening and into said waste container for collection thereof, said waste container being positioned adjacently downstream, in the direction of motion of the surface, of the second end opening of said chute.

9. An apparatus as recited in claim 8, wherein said removing means comprises a brush.

10. An apparatus as recited in claim 9, wherein said disturbing means comprises a thumper.

11. An apparatus as recited in claim 10, wherein said thumper strikes said waste container to prevent nonuniform accumulation of particles therein.

12. An apparatus as recited in claim 11, wherein said device comprises a cam.

13. An apparatus as recited in claim 11, wherein said device comprises a cam shaft.

14. An apparatus as recited in claim 9, wherein said disturbing means comprises a wire.

15. An apparatus as recited in claim 14, wherein said wire being positioned internal to said waste container, said wire being movable through the particles located in said waste container disturbing nonuniform accumulation of particles therein.

16. An apparatus as recited in claim 15, wherein said device comprises a cam.

17. An apparatus as recited in claim 15, wherein said device comprises a cam shaft.

18. A method of preventing particles, removed from a surface and collected in a waste container, from nonuniform accumulation in the waste container, comprising:

removing the particles from the surface using a cleaning device;

collecting particles from the surface that accumulate nonuniformly in the waste container; and disturbing the nonuniform accumulation of the particles in the waste container to create uniform distribution of the particles therein, using a disturbing device, during engaging and retracting of the cleaning device using a cam shaft, coupled to the disturbing device and the cleaning device, to simultaneously operate the cleaning device and the disturbing device.

19. An apparatus for cleaning particles from a cleaner subsystem, the cleaner subsystem having a device for removing the particles from a surface, comprising:

means for cleaning the particles from the cleaner subsystem, the particles removed from the surface forming a bridging accumulation in the cleaner subsystem;

a mechanism for engaging and retracting the device for removing particles from the surface; and means for disturbing the bridging accumulation of the particles in the cleaner subsystem creating uniform distribution of the particles therein, said disturbing means being coupled to said device and being made operable by said mechanism.

20. A method of cleaning particles from a cleaner subsystem having a device for removing the particles from a surface, the cleaner subsystem having bridging accumulation therein, comprising:

removing the particles from the surface using a cleaning device; and disturbing the bridging accumulation of the particles in the cleaner subsystem, to create uniform distribution of the particles therein, using a disturbing device activated during engaging and retracting of the cleaning device using a cam shaft coupled to the disturbing device and the cleaning device, to simultaneously operate the cleaning device and the disturbing device.

* * * * *